US005254969A

United States Patent [19]

Caddock, Jr.

[11] Patent Number: 5,254,969

[45] Date of Patent: Oct. 19, 1993

[54] RESISTOR COMBINATION AND METHOD

[75] Inventor: Richard E. Caddock, Jr., Winchester, Oreg.

[73] Assignee: Caddock Electronics, Inc., Riverside, Calif.

[21] Appl. No.: 32,537

[22] Filed: Mar. 12, 1993

Related U.S. Application Data

[63] Continuation of Ser. No. 758,605, Sep. 12, 1991, abandoned, Continuation-in-part of Ser. No. 679,603, Apr. 2, 1991, abandoned.

[51] Int. Cl.[5] ..... H01C 1/012

[52] U.S. Cl. ..... 338/308; 338/309; 338/314; 338/25; 361/119; 337/297

[58] Field of Search ..... 338/25, 308, 309, 314; 361/119, 103, 406; 337/297, 116, 232

[56] References Cited

U.S. PATENT DOCUMENTS 3,978,443 8/1976 Dennis et al. ..... 338/309
4,959,751 9/1990 Hearn et al. ..... 361/406
4,961,065 10/1990 Taylor ..... 338/308
4,999,731 3/1991 Bender et al. ..... 338/195 X
5,084,691 1/1992 Lester et al. ..... 337/297

FOREIGN PATENT DOCUMENTS 2109760 9/1971 Fed. Rep. of Germany .
3245629 12/1982 Fed. Rep. of Germany .
2163307 8/1994 United Kingdom .

*Primary Examiner*—Marvin M. Lateef
*Attorney, Agent, or Firm*—Richard L. Gausewitz

[57] ABSTRACT

An apparatus and method by which a flat film-type resistor is intentionally caused to thermal-shock fracture in response to a predetermined high-voltage overload condition. A stressed spring wire is mounted on such film-type resistor and connected in circuit with it. A predetermined solder and temperature gradient are employed to hold the spring wire in bent condition until the solder melts, whereupon the spring flexes and the circuit breaks. Heatsink portions are provided in the circuit board for such resistor, and receive terminal pins thereof.

49 Claims, 5 Drawing Sheets

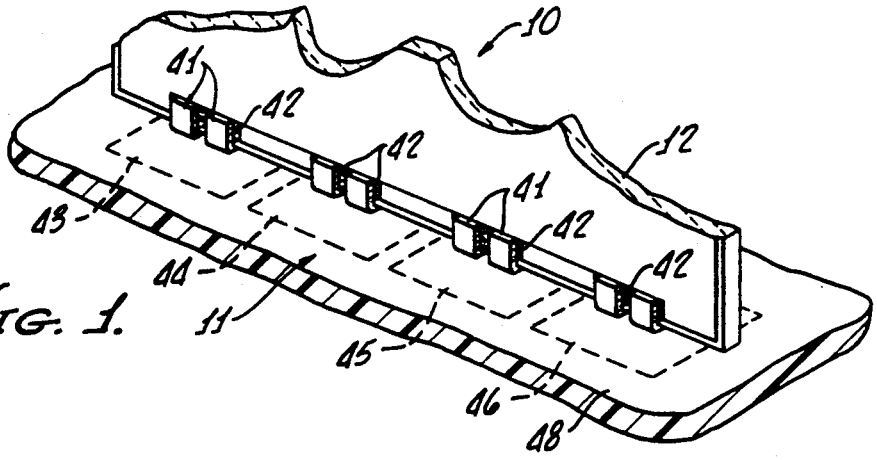
FIG. 1.
FIG. 2.
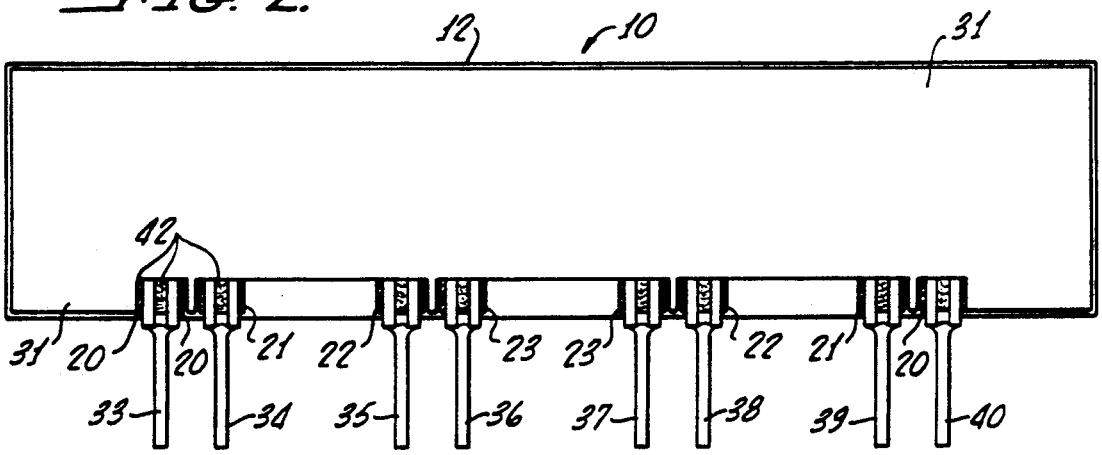
FIG. 3.
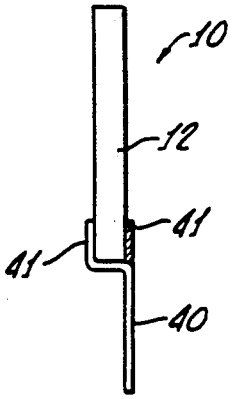
FIG. 14.
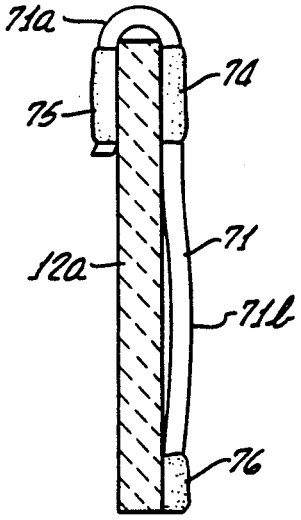
FIG. 15.
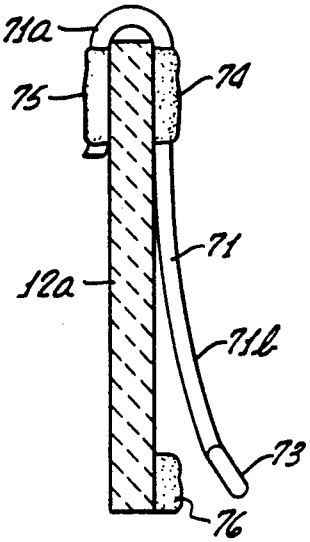

RESISTOR COMBINATION AND METHOD

CROSS REFERENCE TO RELATED APPLICATION

This is a continuation of copending application(s) Ser. No. 07/758,605 filed on Sep. 12, 1991, abandoned, which is a continuation-in-part of co-pending patent application Ser. No. 07/679,603, filed Apr. 2, 1991, now abandoned, for Resistor Combination and Method.

BACKGROUND OF THE INVENTION

It is important that the balancing resistors used in line cards in telephone systems have precise values. Precision resistors permit proper line balancing, and proper balancing causes better voice transmission fidelity and better data transmission accuracy and reliability. Precision resistance values, however, are only one of the factors determining whether or not particular balancing resistors are looked upon favorably by telephone companies.

It is essential that the balancing resistors, and the line cards, perform in certain ways demanded by the telephone companies, at three specified or standard levels of adverse conditions. The first level is one where the line card will survive and continue to function properly despite certain conditions, one being lightning transients. The second level relates to a condition where the balancing resistors are continuously overheating, for example because the line card is overheating due to being improperly connected by a technician. Relative to this second level, there must be a thermal cutoff action to discontinue flow of current before the line-card circuit board starts to burn. The third level is one where there is a sudden application of high voltage, for example when a power line drops on the telephone line. Relative to this third level, current flow must be substantially instantaneously discontinued or small-diameter wires in the telephone system may melt.

The combined requirements for precision balancing, and for the ability to either withstand or fail safely relative to specified types of adverse conditions, must be satisfied by resistors that are physically smaller and smaller in comparison to prior-art resistors, and by resistors having resistance values that are often only a fraction of the values of prior-art resistors. A great problem relative to the needs for physically small balancing resistors, and low-resistance balancing resistors, is that low-resistance resistors have much more power introduced therein during lightning transients and during overload conditions than is the case relative to high-value resistors. For example, if the resistance value is cut in half, the introduced power doubles. Handling high power caused by lightning transients, etc., with physically smaller resistors, is extremely difficult. It is emphasized that physically small resistors inherently have less heat-dissipating surface area and thus are harder to cool in comparison to the physically larger resistors of the prior art.

In sum, telephone companies want the line cards to be small so that there can be more cards in a given space. They therefore want the components on the cards to be small, and they also want the minimum number of components to be employed, while still meeting strict performance requirements.

Relative to the above-mentioned second level of adverse conditions, it is customary to use fuses or thermal cutoffs that are separately manufactured and separately mounted components. These require separate operations to assemble them to the circuit board; furthermore, they require considerable room on the board.

Relative to the above-mentioned third level of adverse conditions, various approaches are employed in the art. These include fuses, voltage-management circuits, etc. These require separate components, and separate mounting operations, as well as needing additional space on the board.

SUMMARY OF THE INVENTION

In accordance with one aspect of the present resistor and method, a film-type balancing resistor is intentionally so constructed that it will thermal-shock fracture and instantly break the circuit when a third-level adverse condition occurs. Thus, there is no need for any separate components, any extra space on the board, etc.

In accordance with another aspect of the present invention, a heat-responsive circuit breaking device is built into a balancing resistor and in such a way that only a small amount of additional resistor size is required in comparison to what would be the case if no such device were present. Since the circuit-breaking device is built into the resistor, no additional assembly operation is required when mounting the resistor on the board.

In accordance with another aspect of the present invention, extremely precision-value balancing resistors are provided on relatively small substrates, and associated with relatively small heatsink areas of circuit boards, in such manner that the precision balancing resistors can be very low in value and still handle relatively large introductions of power, as required by telephone companies.

In accordance with other major aspects of the present resistor and method, certain film resistor layouts, and certain very small spring-wire constructions, are employed—in combination with other elements—to meet the various telephone-company requirements with small and precision components.

BRIEF DESCRIPTION OF THE DRAWINGS

FIG. 1 is an isometric view showing a fractured substrate in combination with the underlying portion of the circuit board;

FIG. 2 is a front plan view of the resistor (network) of FIG. 1, before the fracture occurred, the board being unshown;

FIG. 3 is an end elevational view of the showing of FIG. 2;

FIG. 14 (sheet 1 of drawings) is a greatly enlarged view, partially in cross section and partially in side elevation, taken on line 14—14 of FIG. 10;

FIG. 15 (sheet 1 of drawings) is a view corresponding to FIG. 14 but showing the spring in its position assumed after interruption of the circuit;

DETAILED DESCRIPTION OF THE PREFERRED EMBODIMENTS

Referring first to the embodiment of FIGS. 1–7, a resistor 10 is mounted on a circuit board 11, the latter being shown only in small part, namely that part which provides the mounting region for the resistor 10. The circuit board has not only resistor 10 but also other telephone line-card components thereon; all together form a line card in a telephone system. Each line card conventionally has two to four channels therein, each channel being connected to an above-ground or below-ground subscriber line.

Figure 4:
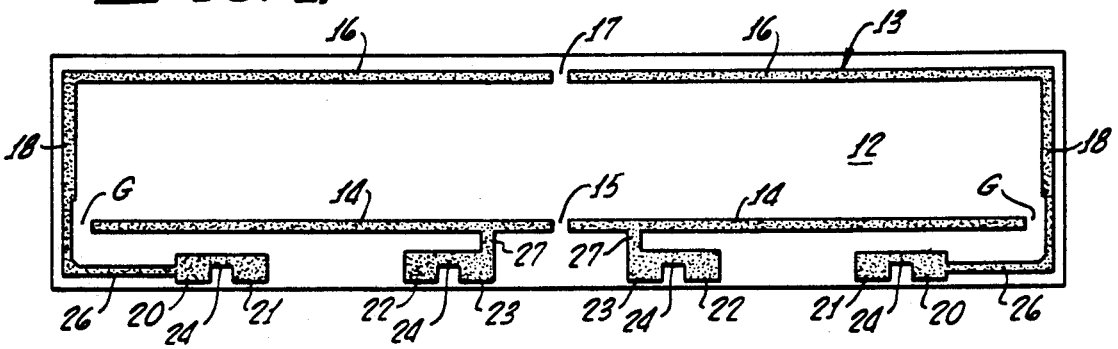
FIG. 4 is a plan view showing the termination traces on both the front and back of the substrate of the resistor of FIGS. 1-3.
Figure 5:
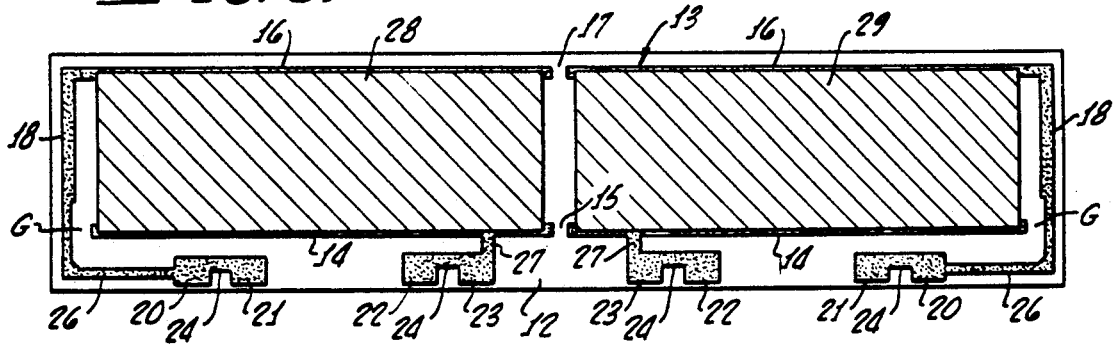
FIG. 5 is a plan view of the front and back of the resistor after application of resistive film thereto, the film being schematically represented by hatching.
Figure 6:
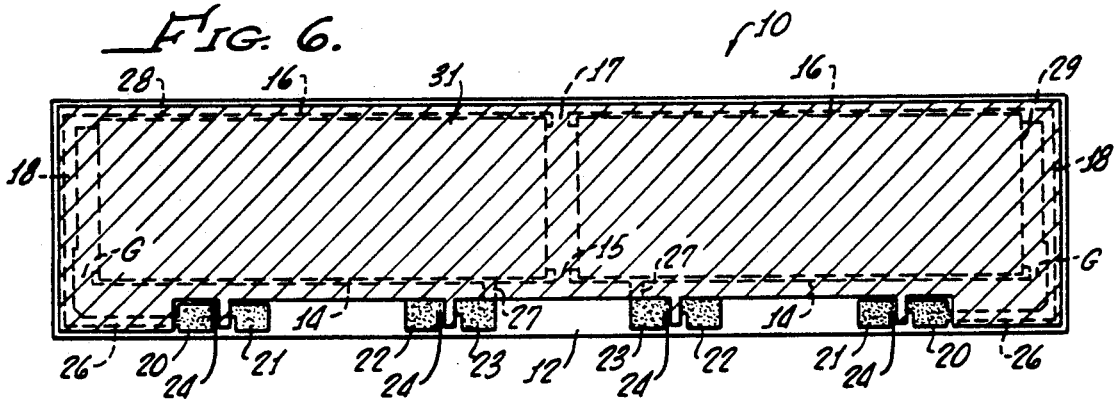
FIG. 6 is a plan view of the front and back of the resistor after application of overglaze thereto, the overglaze being schematically represented by different hatching.
Figure 7:
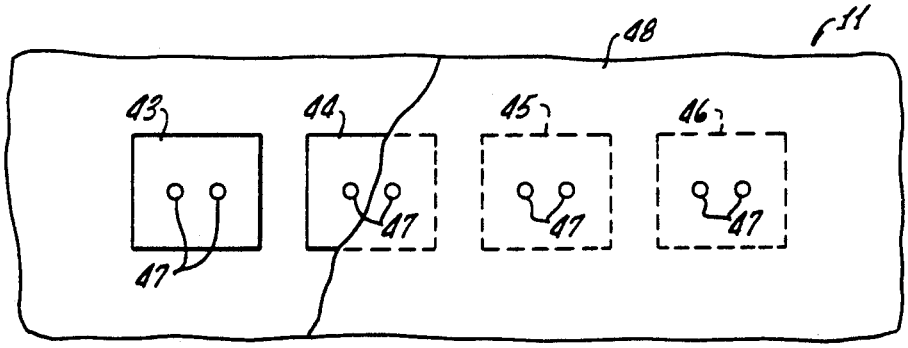
FIG. 7 is a bottom and top plan view of the showing of FIG. 1, illustrating the circuit board region beneath the balancing resistor, the pins being unshown.

FIGS. 4, 5 and 6 show both the front and back of the substrate. FIG. 7 shows both the bottom and top of the underlying circuit board region.

As shown in FIGS. 2–7, the resistor 10 is a film-type resistor having an elongate rectangular substrate 12 that is so constructed and related as to fracture, in a certain general way, when subjected to predetermined thermal-shock conditions, as set forth below.

As shown in FIG. 4, a pattern of termination traces (metallization) 13 is formed on both the front and back of substrate 12. The traces 13 are, for example, formed of a palladium-silver composition and are screen-printed onto the substrate and then fired.

As described below, there are two resistive films on each side of substrate 12. The two films on one half (for example) of the substrate form one resistor; the two films on the other half form another resistor. Such one and such other resistor are balanced (vis-a-vis resistance values) relative to each other, normally in a fifty-fifty manner.

The resistive films on each side of the substrate 12 are separated from each other at a gap region. The resistive films on each side of said gap regions form one of two resistors, such two resistors being the above-stated one resistor and other resistor. Such two resistors are balanced in value relative to each other.

Each of such two-resistors is formed by two parallel-connected resistive films. For each of such two resistors, one of such parallel-connected resistive films is on the front of substrate 12, and the other of such parallel-connected resistive films is on the back of substrate 12.

For such a resistor network, the traces 13 preferably have the following pattern: two lower traces 14 in axial alignment and separated by a central gap 15; two upper traces 16 in axial alignment and separated by a central gap 17; and two end traces 18 connected to upper traces 16 but not to lower traces 14. End traces 18 are spaced a relatively short distance from lower traces 14, the short spacing being to minimize the length of the substrate. Traces 14,16 are parallel to each other and to the upper and lower edges of substrate 12, while end traces 18 are parallel to each other and to the ends of the substrate, being perpendicular to traces 14,16.

The trace pattern further comprises four sets of double pin (solder) pads. Thus, there are two sets of outer pads 20,21 preferably spaced about one third of the way from the substrate ends to the substrate center. There are also two sets of inner pads 22,23 that are spaced outwardly from the substrate center. Thus, the inner ends of lower traces 14 are spaced inwardly from inner pads 22,23. The two pads in each set 20,21 and 22,23 are spaced from each other and connected together by a trace region 24. The pads are closely adjacent the horizontal lower edge of substrate 12.

Outer pads 20,21 are connected by trace regions 26 to the lower ends of end traces 18. Inner pads 22,23 are connected by trace regions 27 to lower traces 14.

Two resistive films 28,29 are applied, by screen-printing, to each side of substrate 12 and in identical relationship to the termination traces 13, as shown in FIG. 5. Thus, each film 28,29 has its upper and lower edges printed over traces 16 and 14, respectively. The ends of films 28,29 are located close to but preferably not over opposite ends of traces 14 and 16. Films 28,29 are electrically-conductive complex metal oxides in a glass matrix.

Referring next to FIG. 6, an arc-minimizing and environmentally protective coating 31 is provided over both sides of substrate 12 and over the traces and resistive films thereon. The coating is not applied over the pads 20–23, or (preferably) to the spaces between adjacent sets 20–21 and 22–23 of pads. The composition and thickness of coating 31 are described below.

Pins 33–40, inclusive, are respectively connected to the pads 20–23 as shown in FIGS. 2 and 3, there being one pin (for example, pin 40 in FIG. 2) connected to two pads on directly-opposite side regions of substrate 12. Each pin has an elongate shank connected integrally, at a shoulder, to jaws 41 that grip the lower edge of substrate 12. For example, there are two jaws on one side of the substrate and one jaw on the other side thereof. The shank of each pin is, for example, 0.010 inch front-to-back and 0.020 inch wide. The pins are preferably phosphor bronze, plated and stamped.

Proceeding next to a description of the circuit board 11, only a portion of which is shown in FIGS. 1, 7 (and 10), this is a conventional epoxy and glass board having copper traces thereon for connection of many components (not shown) in the circuit. In the preferred embodiment of the present combination, board 11 not only has copper traces thereon but also has copper heatsink regions 43–46 on both sides thereof for reception of pins 33–40. Referring to FIGS. 1 and 7, there are (in the present example) four heatsink regions 43–46 on each side of board 11, each region on the top of the board being (preferably) directly in registry with a corresponding region on the bottom side thereof. Eight holes 47 are formed in regions 43–46, there being two holes in each region. The holes 47 are through-hole plated.

The heatsink regions 43–46 are formed by etching during the manufacture of the board, just as the circuit traces on the board are formed. Soldermask coatings 48 are formed on the top and bottom sides of the board 11.

The pins are inserted into the respective holes 47 until the shoulders at the bottoms of jaws 41 engage the upper board surface. Then, solder is applied at each hole 47 to solder the shanks of the pins therein. Preferably, there is no solder present except adjacent the pin shanks, the heatsink regions 43–46 being covered by the soldermask portions.

Description of Method, and Further Description of Article, First Embodiment of the Invention (FIGS. 1–7)

According to a first aspect of the method relative to the first embodiment, a substrate 12 is—intentionally—employed that will substantially instantaneously fracture, as the result of thermal shock, in response to application of a high-voltage overload to either resistor on the substrate, or to both resistors thereon. In accordance with a second aspect of the method, the termination traces, resistive films, and other factors are intentionally caused to be such that, reliably, the thermal-shock fractures will break the circuits substantially instantaneously, terminating all current flow with little or no arcing.

It is to be understood that the presently-described resistors are respectively in circuit with other components of the line card, so that breaking of the circuit through one or both resistors also stops current flow in respective components connected to these resistors.

Thus, the fracture of the substrate satisfies the above-stated third-level adverse condition. When, for example, falling of a high-voltage power line on the telephone line creates an instantaneous high-voltage overload, current flow is terminated so fast that fine wires in the telephone circuit will not melt.

In accordance with another aspect of the method, the termination traces and other factors are caused to be such that the instantaneous thermal-shock breakage occurs at predetermined regions of substrate 12, and not at other regions thereof. This not only reduces debris but, as described below relative to the second embodiment, assures that no significant length of metal element will fall on other components of the circuit board and tend to create arcs or short circuits.

The substrate 12 is sufficiently thin to instantaneously fracture in response to sudden application of a high-voltage (such as 600 volts) overload, but sufficiently thick to satisfy the following two requirements: (1) effect thermal conduction of a substantial amount of heat through the substrate from the resistive films 28,29 to pins 33–40 and thus into the heatsink regions 43–46, and (2) provide sufficient resistance to mechanical breakage that the line card is not fragile.

The material of substrate 12 is selected to satisfy the above-stated criteria. Very preferably, it is a ceramic. The preferred ceramic is aluminum oxide. More specifically, it is preferably 96% aluminum oxide, (available as No. ADS 96R, from Coors Ceramics Co. of Grand Junction, Colo.).

The preferred thickness of the substrate is about 0.040 inch.

Referring to FIG. 1, it is pointed out that the upper-outer regions of the substrate and films thereon are not present. These regions have broken away as a result of the thermal shock fracture. Referring to FIG. 4, it is pointed out that—in the preferred embodiment of the present method—current is conducted to the upper traces 16 by traces 18 located at the ends of substrate 12. Such flow is through pads 20,21 and trace regions 26. The current flows through the films 28,29 and through trace regions 14 and 27 to the remaining pads 22,23 and thus to the circuit board.

By causing the traces 18 to be at the outer ends of the substrate, it is assured that breakage will be at the upper-outer corners and that the traces 18 will break and thus interrupt the circuits through components respectively connected to the resistors. (As noted above, the overload may be applied to only one of the resistors, on only one half of the substrate 12, in which case only one of the traces 18 will break.)

Referring again to FIG. 1, it is pointed out that the central region of the substrate, and all the lower edge of the substrate, are intact. This is the typical condition resulting from the present method and apparatus.

It is emphasized that the thermal-shock fracture of the present resistor is intentional, being for the combined purposes of (1) preventing damage to other elements of the telephone system and (2) eliminating the need for a separate component or circuit adapted to protect against instantaneously-applied high voltages.

Resistors have "exploded" for years due to thermal shock caused by power overload, and this was generally regarded as undesirable. Here, on the other hand, applicant is creating controlled conditions such that a predetermined desired type of "failure" will occur and create a beneficial result. The resistive film and termination traces are so shaped and correlated as to create the necessary stress pattern. The resistive film is made such that application of the voltage being guarded against will generate enough power and heat to fracture the substrate. Conjointly, the substrate is caused to have such composition, and physical shape, that it will properly fracture when the heating occurs.

The breaking of the termination traces 18 as the result of the thermal-shock fracture creates momentary arcing and ionization at the points where such traces initially break. Although the arcing is only of short duration, since the corners of the substrate 12 fall away, the air is ionized in the surrounding regions. This increases greatly the tendency toward arcing at regions of the circuit where the voltage differential is greatest. It is an additional aspect of the present, method to provide the coating 31, to minimize arching between such high voltage-differential regions despite the ionized air thereat.

As shown in FIGS. 4–6, there is a relatively small gap G between the outer ends of lower traces 14 and the lower regions of end traces 18. The gap G is caused to be small in width because every increment that it is enlarged increases the length of substrate 12 by two increments, in the present double resistor. Preferably, the width of each trace 18 opposite trace 14 is somewhat narrower than is the width of each trace 18 at regions spaced above traces 14. This increases gap G without lengthening the substrate and thus the entire resistor, but there are severe limits relative to increasing gap G in this manner.

The additional aspect of the invention comprises providing the arc-resisting coating 31 on the resistor, at least at regions over and relatively near the gaps G, and preferably at all regions except the pads 20–23 and substrate regions between such pads (FIG. 6).

Stated more specifically, the arc-minimizing coating—and which is additionally an environmentally-protective coating—31 is a glass layer having a thickness correlated to the width of gap G. Where the gap G is to be small for minimized resistor size, the glass coating is made thick. On the other hand, where the size of the substrate is not such that each gap G must be small, the thickness of the glass coating 31 is made less in order to minimize cost.

To state specific examples, a 0.001-thick layer of glass has been found to substantially completely protect against failures (for a 600 volt suddenly-applied test voltage) when the gap is 0.032 inch wide. When the deposited glass is 0.0008 inch in thickness, there are some failures for the same gap width. For a glass deposit 0.0006 thick, there are a substantial number of failures for a gap of the specified width. Therefore, for such a gap applicant employs a glass deposit 31 having a thickness of 0.001 inch.

The glass is screen printed onto the substrate above the traces and above the resistive films, as stated above. Glass frit, having a relatively low melting point, is screen-printed onto the region shown in FIG. 6, following which the part is fired in order to fuse the glass particles.

It is important that the glass not degrade the resistive films 28,29. For resistive films that are fired at temperatures of 800 degrees C. and above, the glass frit is caused to have a melting point slightly below 500 degrees C. Thus the firing in order to fuse the layers 3 is at 500 degrees C.

The resistor 10 of the first embodiment will also satisfy the above-stated first level of adverse conditions, namely that the resistor will survive and operate properly under adverse conditions, such as those created by lightning transients. This is because of reasons including the good heat transfer characteristics from the resistor 10 to the circuit board and outwardly from the pins 33–40. This, however, is described below relative to the second embodiment of the invention.

Resistor Combination and Method of the Second Embodiment of the Invention, FIGS. 7–15, Inclusive.

An exemplary length for the above-described resistor 10 is 1.8 inches. By making it (for example) 2 inches long, namely by adding 0.2 inch to the length of the substrate, the resistor combination is made to satisfy all three of the levels of adverse conditions. This eliminates the need for a separate thermal cutoff element in order to satisfy the second level.

The front side and back side of the above-described resistor of FIGS. 1–6 are preferably identical, as previously stated. In the resistor of the second embodiment, the front and back sides are normally not identical to each other and thus, relative to some regions thereof, are separately described. With the major exceptions stated below, the resistor (and circuit board) of the second embodiment is identical to resistor 10 of the first embodiment. Elements in the second embodiment that substantially correspond to elements in the first embodiment are given the same reference numerals, except followed in each instance by the letter "a".

Figure 8:
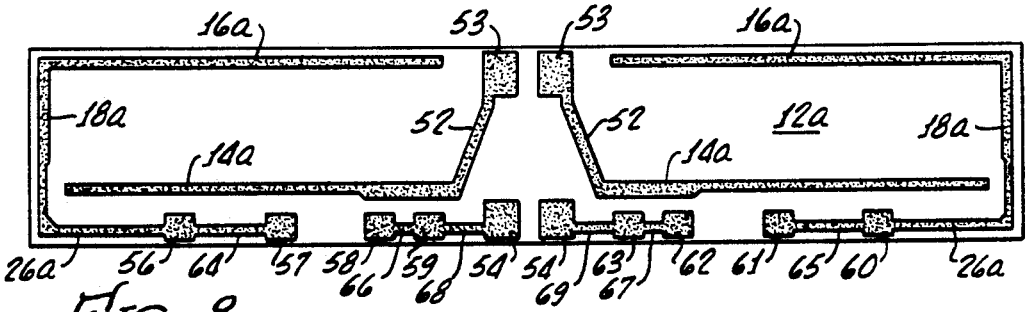
FIG. 8 is a front plan view showing the traces of a balancing resistor according to a second embodiment, having means thereon for discontinuing current flow when a second-level adverse condition occurs.
Figure 10:
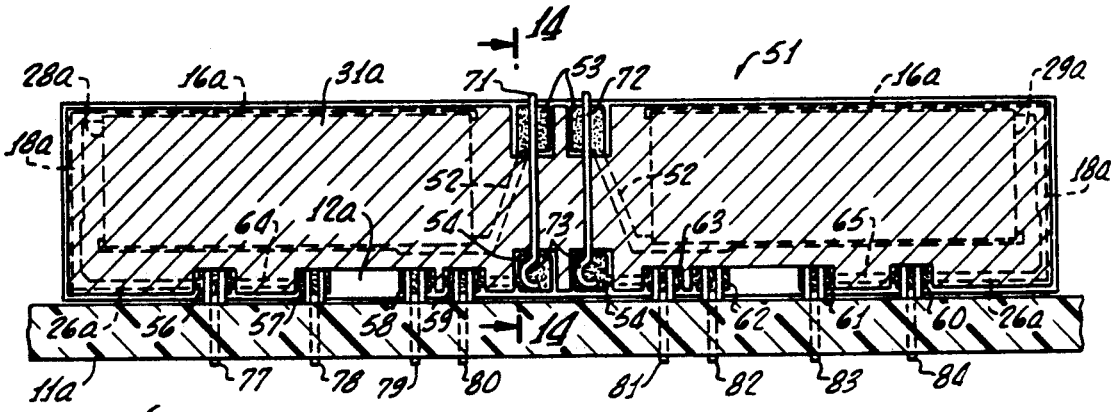
FIG. 10 is a front plan view corresponding to FIG. 9 and also showing overglaze and circuit-breaking spring means, as well as the pins and (in section) the underlying region of the circuit board, the heatsinks and solder being unshown.

The resistor combination of the second embodiment is numbered 51 (FIG. 10). Referring to FIG. 8 (front view) and FIG. 11 (back view), the substrate **12*a* has upper traces 16*a* and end traces 18*a* as well as lower traces 14*a*. The inner ends of traces 16*a* and 14*a* on each half of the resistor are spaced further apart than is the case relative to the resistor of the first embodiment. On both sides of the resistor, trace sections 52 connect to the inner ends of lower traces 14*a* and extend upwardly and inwardly to pads 53, respectively. The two pads 53 on each side of the substrate are spaced apart, and are adjacent the upper edge of substrate 12*a*. Adjacent the bottom edge of the substrate, on only the front of the resistor, are pads 54 (FIG. 8). Such pads 54 are respectively directly below the pads 53** on the substrate front.

Pads 56–63 (FIG. 8) are provided along the bottom edge of substrate **12*a*, the pads 56–59 on one half of the substrate 12*a* being, respectively, the mirror images of the pads 60–63 on the other half of the substrate. Pads 56 and 60 are respectively connected to trace regions 26*a* and thus through end traces 18*a* to upper traces 16*a*. Trace portions 64 and 65 respectively connect pads 56,57 and pads 60 and 61** together.

Pad 56 is spaced a substantial distance from the end of the substrate and from the next pad 57. Correspondingly, pad 60 is spaced a substantial distance from the end of the resistor and from pad 61. On the other hand, pads 58,59 are quite close to each other, as are pads 62,63. The pad pair 58,59 is close to the inner end portion of trace **14*a*, which inner end portion is relatively wide as shown. Correspondingly, the pad pair 62,63 is relatively close to the inner end of the right lower trace 14*a***, which inner end portion is relatively wide as shown.

Trace region 66 connects together the pads 58,59; trace region 67 connects together pads 62,63. Trace region 68 connects pad 59 to pad 54, while trace region 69 connects pad 63 to the other pad 54.

Figure 11:
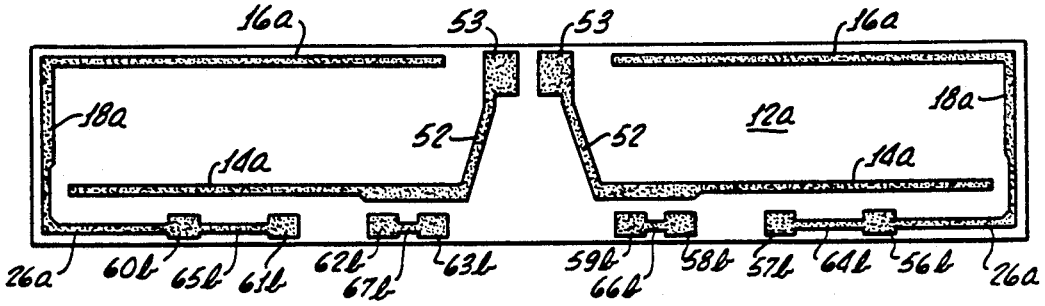
FIG. 11 is a back plan view showing the termination traces on the back of the resistor of FIGS. 8–10.

There are no pads 54 or trace regions 68 or 69 on the back of the substrate (FIG. 11). Elements 56, 64, 57, 58, 66, 59, 63, 67, 62, 61, 65 and 60 have corresponding elements on the back of the substrate, and these are given the same reference numerals except followed in each instance by the letter "b".

Figure 9:
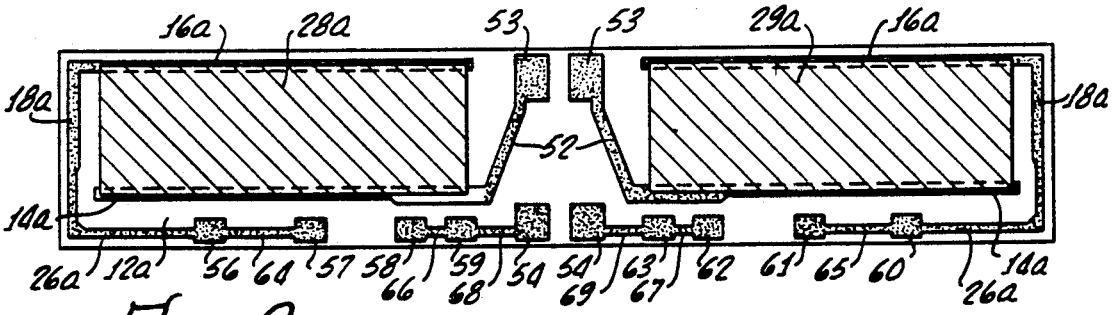
FIG. 9 is a front plan view corresponding to FIG. 8 and showing the resistive film.
Figure 12:
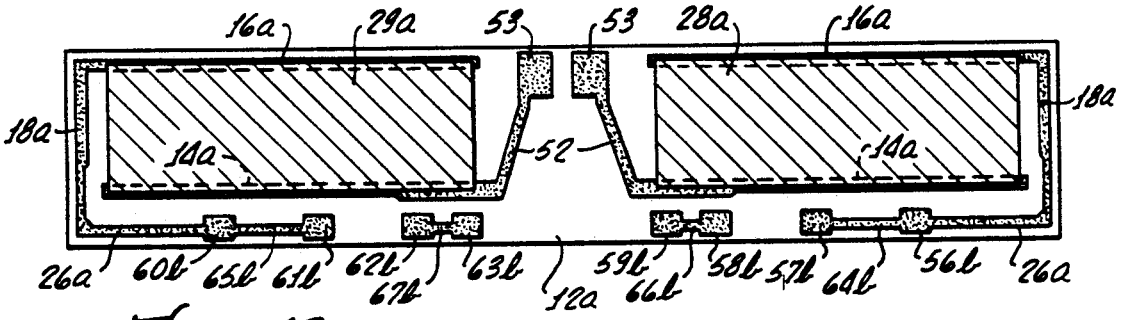
FIG. 12 is a back plan view showing the resistive film on the back of such resistor.

Resistive films **28*a* and 29*a* are applied between the upper and lower termination strips 16*a* and 14*a*, as shown in FIGS. 9 and 12. A layer of overglaze 31*a*, FIGS. 10 and 13, is applied over each side of each resistor, except (in the example) at the various pads and except between pads 57–58 and 61–62 (and 57*a*–58*a* and 61*a*–62*a***).

The Spring-Wire Cutoff

An electrically conductive spring wire 71 is soldered between the pads 53,54 on the front of the left resistor (FIG. 10). An electrically conductive spring wire 72 is soldered between pads 53,54 on the front of the right resistor. Each wire 71,72 is not in its free condition but instead is in stressed or flexed condition, the relationships being such that the lower end of each wire will spring away from its pad 54 in response to melting of the solder at such pad. (The solder is not shown in FIGS. 10 or 13, but is shown in FIGS. 14 and 15, first sheet of drawings.)

Figure 13:
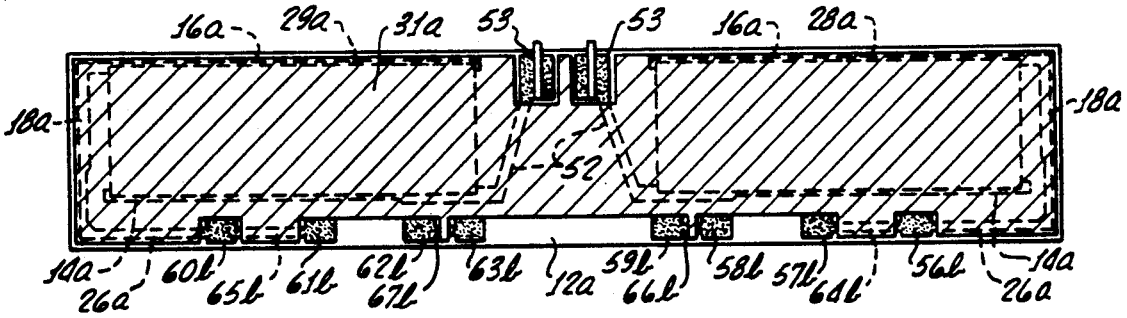
FIG. 13 is a back plan view showing the overglaze on the back of such resistor, this being the rear view of FIG. 10 but with the pins and circuit board portion being unshown, the solder being unshown.

The upper ends of spring wires 71,72 are bent in hairpin relationship around the upper edge of substrate 12*a*, and are soldered to the pads 53 on the back of the substrate (FIGS. 13 and 14). Thus, the relationships are such that current flow from both resistive films 28*a*—on the front and back of the substrate 12*a*—flows through traces 52 and thence through the spring wire 71 to pad 54 and its associated pins. The same current flow pattern occurs—in mirror-image relationship to that just described—relative to the films 29*a*, the current flowing in series through spring wire 72.

The lower end of each wire 71,72, at its associated pad 54, is bent ("kinked") in semi-circular relationship so as to increase the amount of wire metal associated with the solder on each pad 54, reference being made to FIG. 10.

Referring next to FIGS. 14 and 15 (first sheet of drawings), these show spring 71 in two positions; it is to be understood that the same views apply also to spring 72 and its associated attachments. Spring 71 has a U-shaped upper end 71*a* the arms of which seat (due to spring bias) against pads 53 on directly-opposite sides of substrate 12*a*. Such arms are secured to such pads by solder 74,75.

Below solder 74, which is on the front side of substrate 12*a*, spring 71 is bent along a flex region 71*b*, which is under stress tending to spring it to the position of FIG. 15. When in normal position, FIG. 14, the lower end of portion 71*b* is secured to pad 54 by solder 76, the latter being associated with the kink 73 shown in FIG. 10.

Eight pins 77–84 are connected, at their jaws, to the respective pads 56–59, 63, 62, 61 and 60. As described relative to the first embodiment, these pins are passed through and soldered in through-hole plated holes in circuit board 11*a* (FIG. 10). Around the holes on both sides of the board are heatsink regions corresponding to those described above, except for location. There are two heatsinks, directly opposite each other at each pin or pair of pins, as shown in FIG. 7 except for the spacing of the pin holes to correspond to and receive the pins shown in FIG. 10.

The material employed by applicant for the spring wires 71,72 is stainless steel, 17-7 PH, condition C. The diameter of each wire is 0.012 inch. The preferred range of diameters for the spring wires 71,72 is about 0.005 inch to about 0.020 inch.

Each spring wire is silver plated. The solder employed at pads 54 on the front side of the substrate 12*a*, and preferably also at all other pads on the substrate, is 96.5% tin and 3.5% silver. The melting point of this eutectic is 221 degrees C.

The solder which connects the pins to the circuit board 11*a* is 63% tin—37% lead, which melts at 183 degrees C., namely 38 degrees C. lower than the melting point of the specified tin-silver solder.

In accordance with one aspect of the present method and apparatus, although the melting point of the solder on the substrate is distinctly higher than that of the solder that connects the pins to the circuit board, the latter solder does not melt until (if at all) after solder 76 (FIGS. 14 and 15) melts to release the springs 71,72 from the FIG. 14 position to the open-circuit FIG. 15 position.

Because of the close proximity of pads 58,59 and 54, and 62,63 and 54, to the lower-inner corners of resistive films 28*a* and 29*a*, these pads and the solder thereon become relatively hot. This is especially true since the substrate 12*a* is a relatively good thermal conductor (for a ceramic) and conducts heat from the corner regions of the resistive films to the specified pads. Much of this heat is dissipated not only into the circulating air in the chamber containing the line card, but (importantly) down the pins 79,80 and 81,82 to the circuit board 11*a* and the copper heatsinks thereon on both sides thereof.

The distinct thermal gradients down such pins, and through the heatsinks away from the pin portions in the circuit, are such that the conventional solder at the circuit board does not melt before the springs 71, and/or 72, release or "trip".

Additional Disclosure and Discussion

The same thermal-gradient action, with temperature decreasing down the pins from the pads to the circuit board, is also present in the above-described first embodiment, and makes such embodiment—and the present one—better able to withstand the first level of adverse conditions.

The present second embodiment also withstands the second level of adverse conditions, because the springs (one or both) trip and discontinue current flow to thus protect the board and insure that it does not burn. To again adapt the line card for operation, the technician replaces the present resistor combination with one identical to it.

Relative to the third level, instantaneous high-voltage overload, the springs 71,72 do not trip. Instead, the upper regions of the substrate 12*a* fracture away due to thermal shock. The pattern may be, for example, similar to that shown in FIG. 1. The central region of the substrate 12*a* does not break; thus, the springs 71,72 and their associated elements do not fall onto other portions of the board and possibly create arcs.

To manufacture the resistor combination of the present embodiment, the pins 71–84, which are all connected to a tie bar (not shown), at the jaws of such pins are mounted over the bottom edge of substrate 12*a* at the respective pads. The lower portions of spring wires 71,72 are initially much longer than shown, and project downwardly from the substrate to regions behind the tie bar. Thus, the tie bar holds the spring regions in contact with pads 54, the springs then being in the flexed relationship of FIG. 14.

Then, the assembly is dipped into a molten bath of the specified solder or (less preferably) another solder, to simultaneously secure all of the jaws to the respective pads and to secure the springs to pads 54. The spring portions adjacent upper pads 53 may be soldered in a separate dipping operation conducted later, or at the same time by dipping the entire resistor into the solder bath. Thereafter, the tie bars and the projecting spring regions are cut off.

Exemplary resistors embodying the present invention have a value of fifty ohms, that is to say a total of fifty ohms on each side of the center of the substrate. Such 50-ohm resistors have a rating of 3.125 watts each, with application of 12.5 volts, and operate continuously up to 85 degrees C. ambient temperature in the chamber containing the line cards. Above 85 degrees C., the combination of ambient temperature and the temperature generated by the resistors at the lower ends of springs 71,72 causes the springs 71,72 to trip and discontinue current flow.

It is to be understood that, with film resistors having certain ohm values, there may be films on only one side of the subtrate instead of both sides thereof.

Figure 16:
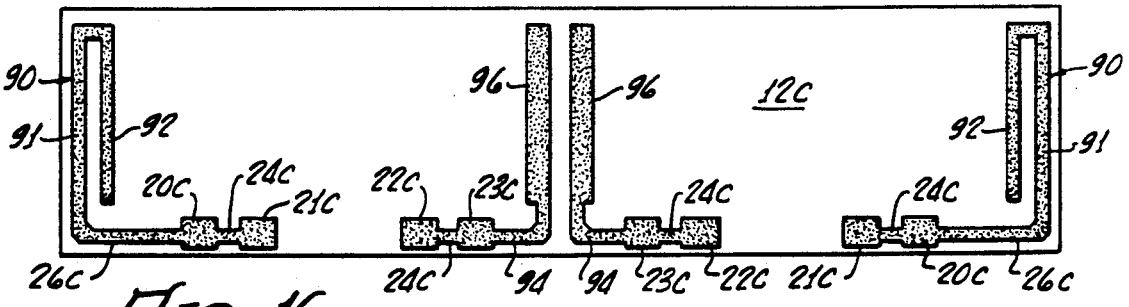
FIG. 16 is a plan view showing the termination traces on both the front and back of the substrate of a third embodiment of balancing resistor.
Figure 17:
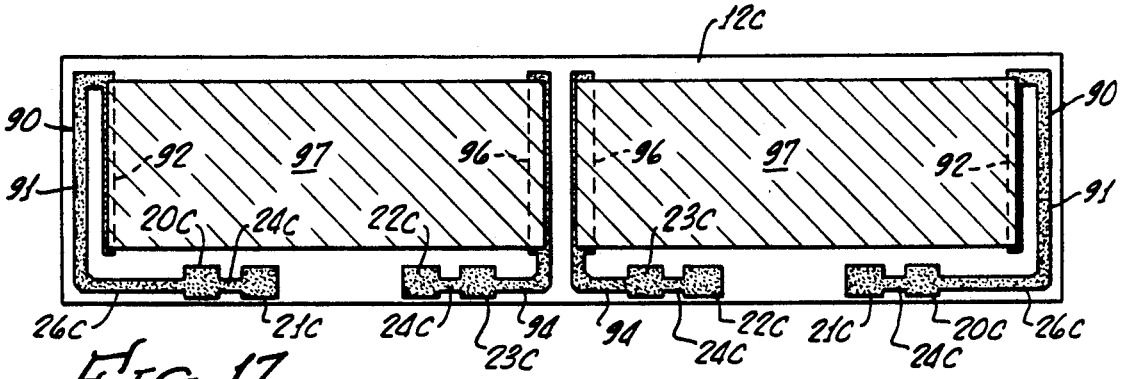
FIG. 17 is a plan view of the front and back of the resistor of the third embodiment, after application of resistive film thereto.
Figure 18:
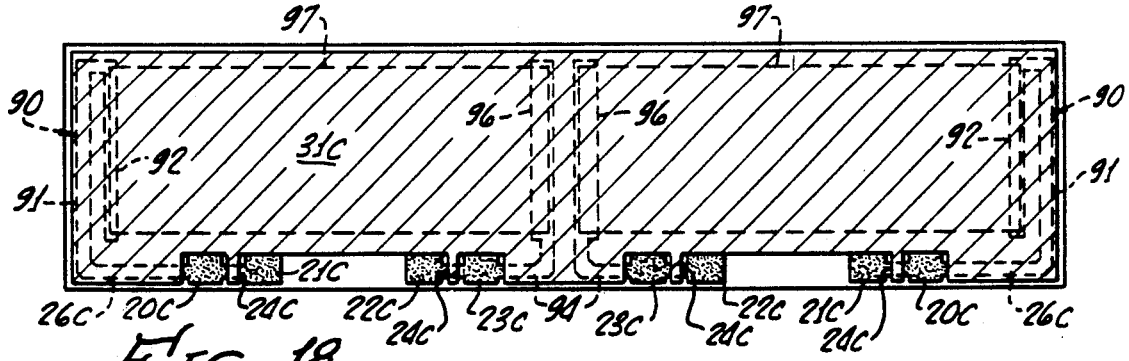
FIG. 18 is a plan view of the front and back of the resistor of the third embodiment, after application of overglaze thereto.
Figure 19:
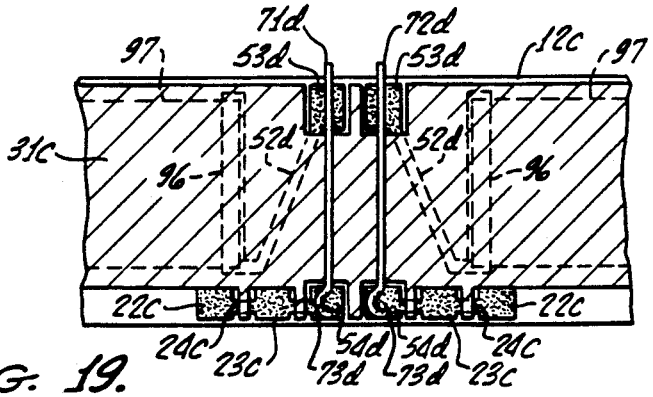
FIG. 19 is a plan view of the front of a balancing resistor according to a fourth embodiment, the end portions of the resistor being unshown.

Description of the Third (FIGS. 16–18) and Fourth (FIG. 19) Embodiments of the Invention The resistors and combinations described below relative to FIGS. 16–19 are, except as specifically stated below, identical to the resistors described above relative to FIGS. 1–15. The same pins and circuit board are employed relative to the embodiments of FIGS. 16–19 as are employed relative to the embodiments described above relative to FIGS. 1–15. Stated more specifically, and except as stated below, the embodiment of FIGS. 16–18 is identical to that of FIGS. 1–7; similarly, the embodiment of FIG. 19 is (except as stated below) identical to that of FIGS. 8–15.

Referring to FIGS. 16–18, the parts that correspond substantially to those in FIGS. 4–6 are given the same reference numerals except followed in each instance by the letter "c". It is emphasized that FIGS. 16–18 show both the front and back of the resistor.

Substrate 12*c* has provided thereon sets of pin pads 20*c*,21*c* and 22*c*,23*c*. The pads in each set are connected together by trace regions 24*c*. Extending horizontally outwardly from the two pads 20*c* are lower trace regions 26*c*.

The outer ends of trace regions 26*c* connect to reverse-bent, inverted U-shaped, or hairpin-shaped trace regions 90. The trace regions 90 at opposite ends of the resistor combination are mirror images relative to each other about a vertical central plane (which plane is perpendicular to the plane of the paper on which the drawings appear), as are other trace regions and other elements of the resistors in the preferred forms thereof. Each trace region 90 has an outer arm 91 parallel to the outer edge of the substrate and extending to a point relatively near the upper edge thereof. It also has an inner arm 92 parallel to outer arm 91 and spaced sufficiently far therefrom that there will be no voltage breakdown therebetween. Although outer arm 91 (trace region 91) extends all the way to trace region 26*c*, the inner arm (trace region) 92 terminates—at its lower end—a substantial distance above trace region 26*c*. The outer and inner arms are connected to each other at their upper ends, by the illustrated upper horizontal trace regions.

Referring next to the central portion of the resistor combination of FIGS. 16–18, pads 23*c* connect to trace regions 94 that extend horizontally toward but not to the above-indicated central plane. Trace regions 94 extend upwardly to vertically elongate end pads 96. These pads 96 are disposed sufficiently far on opposite sides of the central plane that there will be no arcing therebetween. Each pad 96 is much wider than is the trace region 92 at the outer end portion of the resistor.

As shown in FIG. 17, horizontally elongate resistive films 97 extend between and in overlapping relationship relative to the trace regions 92 and the end pads 96 at opposite ends of each half of the resistor combination. The upper edge of each film 97 is spaced below the upper edge of substrate 12*c*; the lower edge of each film 97 is spaced above the pin pads 20*c*,21*c* and 22*c*,23*c*.

As shown in FIG. 18, a protective coating 31*c* is provided over the films and the traces as previously described, leaving only the pin pads and certain substrate regions exposed.

In the embodiment of FIGS. 4–6, etc., current flow is vertically between the trace regions 14 and 16. In the present embodiment, on the other hand, current flow is horizontally between the trace regions 92 and end pads 96. The embodiment of FIGS. 16–18 is preferred when the resistance values of films 97 are relatively low, lower than those of the films 28,29.

The embodiment of FIGS. 16–18 has trace regions relatively adjacent the upper outer (corner) portions of substrate 12*c*, which trace regions will instantaneously be broken in response to thermal-shock fractures of the substrate 12*c* as described in detail above.

Referring next to FIG. 19, which shows the front of the fourth embodiment of the invention, this resistor combination has a substrate that, other things being equal, is somewhat longer than that illustrated in FIGS. 16–18. Except at the central regions of the resistor as described below, the resistor of FIG. 19 is identical to that of FIGS. 16–18. Thus, except at the central termination regions, the resistor of FIG. 19 is given the same reference numerals as those of FIGS. 16–18. Although the outer end portions of the resistor combination of FIG. 19 are not shown, it is to be understood that they are the same as what is shown at the outer end portions of FIGS. 16–18.

The central region of the resistor combination of the fourth embodiment, FIG. 19, corresponds to what is described in detail above relative to the central regions of FIGS. 8–15—except as stated below. Thus, the same reference numerals are employed except followed in each instance by the letter "d".

The difference is that the trace sections 52*d* on both sides of the resistor (namely, on the front and on the back of the resistor), and on both sides of the central plane of the resistor, connect to the end pads 96 instead of connecting to the elements 14*a* of the second embodiment (FIG. 8, etc.). There are no direct connections between end pads 96 and pin pads 23*c* (such as are provided by trace regions 94 shown in FIG. 16, etc.). Instead, the connections to the end pads 96 are through the conductive springs 71*d* and 72*d*, and thence to pads 54*d* which connect to pads 23*c*.

Instead of employing the illustrated trace sections 52*d*, there may be short horizontal trace sections extending from the upper ends of pads 96 to pads 53*d*.

In the resistor of the third embodiment, FIGS. 16–18, current flows from pin pads 20*c* and 21*c* through trace regions 26*c* to trace regions 91 and 92, thence horizontally through the resistive films 97 to end pads 96, thence through trace regions 94 to pin pads 22*c* and 23*c*. In the fourth embodiment, FIG. 19, current flows from pin pads 20*c* and 21*c* through trace regions 26*c* to trace regions 91 and 92, thence horizontally through the resistive films 97 to end pads 96, thence through trace regions 52*d* on both the front and back of the resistor to springs 71*d* and 72*d*, and thence through the springs to pads 54*d* leading to pads 22*c* and 23*c*. When thermal shocks break off the corners of the substrate, the circuits are broken as described in detail above. When the solder at pads 54*d* melts, the springs 71*d* and/or 72*d* spring outwardly and break the circuits as described relative to FIGS. 14 and 15 (first sheet of drawings). The solder is shown at 74–76 in FIGS. 14 and 15 (first sheet of drawings) but is not shown in FIG. 19.

The foregoing detailed description is to be clearly understood as given by way of illustration and example only, the spirit and scope of this invention being limited solely by the appended claims.

What is claimed is:

1. A resistor, which comprises:

(a) a substrate adapted to have resistive films applied thereto, said substrate having a front side and a back side, said substrate being so constructed and shaped that it will fracture substantially instantaneously in response to thermal shock when a high voltage is applied to the below-stated resistive films on said front and back sides of said substrate, (b) a resistive film applied to said front side of said substrate, (c) a resistive film applied to said back side of said substrate, and (d) termination means connected to said films to connect the same into an electrical circuit, said termination means including electrically conductive termination traces on opposed end regions of said front side of said substrate and on opposed end regions of said back side of said substrate, said traces being respectively spaced from outer end portions of said resistive films and being adapted to break substantially instantaneously when said end regions of said substrate fracture in response to a high voltage applied to said films, said resistive films, substrate, and termination means being such that said thermal shock fracture breaks the circuit through both of said resistive films and thus through said resistor.

2. The invention as claimed in claim 1, in which said substrate is a ceramic that is continuous and is resistant to mechanical breakage.

3. The invention as claimed in claim 2, in which said substrate is sufficiently thin to fracture in response to a high-voltage overload applied to said resistive films, and is sufficiently thick to withstand substantial mechanical stresses.

4. The invention as claimed in claim 3, in which said substrate has a thickness on the order of 0.040 inch.

5. The invention as claimed in claim 3, in which said termination means further comprises electrically conductive lower traces applied to both said front side and said back side of said substrate and connected to said resistive films thereon, and also comprises pins mounted on said substrate and soldered to said lower traces for connection to a circuit board.

6. The invention as claimed in claim 1, in which said resistive films are shaped substantially correspondingly to each other, and are substantially registered with each other.

7. The invention as claimed in claim 1, in which said resistive film on said front side of said substrate is connected in parallel relation with said resistive film on said back side of said substrate.

8. The invention as claimed in claim 5, in which said resistor is mounted on a circuit board, said pins being inserted in holes in said board, and in which said circuit board has heatsink elements thereon at said pins.

9. The invention as claimed in claim 8, in which said pins are soldered to said substrate by a relatively high melting-point solder, and are soldered to said board by a relatively low melting-point solder.

10. The invention as claimed in claim 3, in which glass coatings ar e provided over said films and traces.

11. The invention as claimed in claim 1, in which said high voltage is 600 volts.

12. A film-type resistor with built-in circuit breaking capability in response to sudden overload, which comprises:

(a) a flat ceramic substrate, (b) resistive film means applied on said substrate, (c) termination traces applied on said substrate and connected to said film means, (d) termination pins mounted on said substrate and connected to said traces, said resistive film means, said substrate, and said traces being constructed and oriented so that said substrate and thus said traces undergo thermal shock fracture when a high-voltage overload is suddenly applied to said pins, thereby breaking said traces and thus the circuit through said resistive film means, and (e) heat-responsive circuit breaker means provided on said substrate in circuit with said resistive film means, said circuit breaker means being adapted to melt and break the circuit through said resistive film means in response to sustained excessive flow of current through said resistive film means, as distinguished from application of a high-voltage overload thereto.

13. The invention as claimed in claim 12, in which said substrate is elongate, and in which said termination traces include a trace portion disposed between an end of said resistive film means and an end of said substrate, the relationship being such that a corner portion of said substrate, and said trace portion, fracture as the result of said high-voltage overload, and in which said heat-responsive circuit breaker means is mounted on a portion of said substrate not at said corner portion thereof.

14. The invention as claimed in claim 12, in which said resistor is mounted on a circuit board, said termination pins being inserted in holes in said board, and in which said circuit board has heatsink elements thereon at said pins.

15. The invention as claimed in claim 14, in which said pins are soldered to said board by a relatively low melting-point solder, in which said heat-responsive circuit breaker means includes a relatively high melting-point solder, and in which said pins and heatsink elements are such that said relatively high melting-pint solder melts before said relatively low melting-point solder melts.

16. The invention as claimed in claim 12, in which said high-voltage overload is 600 volts, and in which said relationships are such that said fracture occurs substantially instantaneously.

17. The invention as claimed in claim 12, in which glass film is provided over said film means and said traces.

18. Telephone circuit balancing resistors, comprising:

(a) an elongate flat rectangular substrate having a front surface and a back surface, (b) resistive films applied to said front surface and back surface of each half of said substrate, the resistive films on each surface of said substrate being separated from each other at a gap region, said front and back resistive films on each side of said gap regions forming one of two resistors, said resistor on each side of said gap regions being balanced in value relative to said resistor on the other side of said gap regions, (c) four pins mounted along the lower edge of said substrate, there being two pins for the resistive films on the front surface and back surface of said substrate at opposite sides of said gap regions, and (d) termination traces applied to said substrate and connected between said pins and said films, said termination traces and the two pins on one side of said gap regions connecting in parallel with each other said films on said front surface and back surface of said substrate on said one side of said gap regions, said termination traces and the two pins on the other side of said gap regions connecting in parallel with each other said films on said front surface and back surface of said substrate on said other side of said gap regions, said substrate, said resistive films and said termination traces being such that application of a high-voltage overload to said pins causes sudden thermal shock fracture of said substrate and thus said traces, to substantially simultaneously break the circuit through both the front and back resistive films of at least one of said resistors, characterized in that said termination traces include end traces regions extending along each end portion of said substrate in spaced relationship from said respective resistive films, and respectively connected between two of said pins and edge portions of said films, the relationship being such that high voltage applied to said pins causes thermal shock fracture of said substrate and thus said trace regions at said substrate end portions, the fracture being only at parts of said substrate that do not include said gap regions.

19. The invention as claimed in claim 18, in which said substrate has continuous front and back surfaces and is resistant to mechanical breakage.

20. The invention as claimed in claim 18, in which a stressed spring wire is soldered to said substrate and connected in circuit with said traces for at least one of said resistors, the solder for said spring wire being adapted to melt at one end of said stressed spring wire so that said one end springs away from said substrate and breaks the circuit when excessive heating occurs.

21. The invention as claimed in claim 20, in which there are two such spring wires located in at least one of said gap regions, one end of each of said wires being connected to said front and back resistive films on said front and back of said substrate.

22. The invention as claimed in claim 18, in which said termination traces further include bottom trace regions extending along the bottom edge portions of said substrate near said end portions of said substrate and spaced below said respective resistive films, said bottom trace regions connecting respectively to the bottom ends of said end trace regions and being in the circuits between said films and said two pins, said end trace regions and bottom trace regions on said front surface of said substrate being substantially mirror images of each other, said end trace regions and bottom trace regions on said back surface of said substrate being substantially mirror images of each other, and in which a stressed spring wire is soldered to said substrate and connected in circuit with said traces for at least one of said resistors, the solder for said spring wire being adapted to melt at one end of said stressed spring wire so that such one end springs away from said substrate and breaks the circuit.

23. The invention as claimed in claim 18, in which said front and back resistive films on one side of said gap regions are substantially correspondingly shaped and sized and are substantially registered with each other, and in which said front and back resistive films on the other side of said gap regions are substantially correspondingly shaped and sized and are substantially registered with each other.

24. The invention as claimed in claim 18, in which said termination traces further include bottom traces regions extending along the bottom edge portions of said substrate near said end portions of said substrate and spaced below said respective resistive films, said bottom trace regions connecting respectively to the bottom ends of said end trace regions and being in the circuits between said films and said two pins, said end trace regions and bottom trace regions on said front surface of said substrate being substantially mirror images of each other, said end trace regions and bottom trace regions on said back surface of said substrate being substantially mirror images of each other.

25. The invention as claimed in claim 18, in which glass coatings are provided over said traces and over said resistive films to minimize arcing therefrom during said thermal shock fracture.

26. A combination resistor-breaking element, which comprises:

(a) a substrate having a front and a back, (b) resistive films provided on said front and back of said substrate, (c) termination means provided on said substrate and connected to said films, (d) an elongate electrically-conductive spring element mounted on said substrate in a circuit with both of said films, said spring element being under a stressed condition such that one end thereof constantly attempts to spring away from said substrate, and (e) solder means to hold said one end of said spring element in place on said substrate despite such stressed condition of said spring element, said solder means being adapted to melt, in response to overheating of said resistive films and any associated elements, and thus permit separation therefrom of said one end so that said circuit is broken and said resistive films and any other elements in said circuit are protected.

27. The invention as claimed in claim 26, in which said substrate is flat and formed of a ceramic.

28. The invention as claimed in claim 27, in which said spring element is a spring wire the other end of which is return-bent around one edge of said substrate.

29. The invention as claimed in claim 28, in which one of said resistive films and said spring wire are on one side of said substrate, and in which the other of said resistive films is on the other side of said substrate and is connected to said return-bent end of said spring wire on said other side of said substrate.

30. The invention as claimed in claim 27, in which said resistive films and said ceramic are constructed and oriented to cause thermal shock fracture of said ceramic, and thus breaking of said circuit through said films, in response to application of high voltage to said termination mean.

31. The invention as claimed in claim 30, in which said resistive films and said termination means are such that said thermal shock fracture does not break the region of said ceramic underlying said spring wire, so that said spring wire does not fall off said substrate in response to said thermal shock fracture.

32. The invention as claimed in claim 31, in which said termination means includes pins soldered to said substrate and adapted to be soldered to a circuit board, in which said pins are projected through holes in a circuit board and soldered thereto, and in which said solder means on said substrate has a substantially higher melting point than does the solder which secures said pins to said board.

33. The invention as claimed in claim 32, in which heatsink pads are provided on said board at said holes therein to conduct heat away from said pins.

34. The invention as claimed in claim 27, in which said films are applied by thick-film screen printing on said substrate, in which said termination means includes termination traces on said substrate, and in which an arc-minimizing overglaze is screen-printed onto said substrate over said films and said traces.

35. A telephone resistor adapted to break a telephone circuit in response to two types of overload conditions, said resistor comprising:

(a) a thin substrate having front and back flat surfaces, (b) a resistive film provided on said substrate, (c) terminal means for said film, to connect the same in a telephone circuit, said substrate being adapted to thermal-shock fracture, and break said circuit through said film, in response to sudden application of a 600-volt overload to said terminal means, said breakage being so fast that fine wires in the telephone circuit will not melt, and (d) heat-responsive breaker means mounted on said substrate and connected in said circuit to break said circuit through said film in response to a protracted current overload.

36. The invention as claimed in claim 35, in which said flat surfaces are continuous.

37. A method of breaking, in response to a sudden high-voltage overload, a telephone circuit having a resistor therein, which comprises:

(a) providing said resistor in the form of a resistive film on a flat thin substrate adapted to thermal shock fracture, said substrate having front and back surfaces each of which is continuous, (b) intentionally selecting the thermal shock feature characteristics of said substrate having said film thereon, so that said substrate will substantially instantaneously fracture in response to a 600-volt overload such as results when a power line comes in contact with telephone lines, and will break the circuit through said film, (c) connecting said resistor to a circuit board in a telephone circuit that will be subjected to high-voltage overloads when a power line comes in contact with a telephone line connected to said telephone circuit, and (d) effecting said connecting through electrically conductive trace portions on said substrate and that are located at opposed end portions of said substrate in spaced relationship from said film thereon and generally perpendicular to said circuit board.

38. A method of making a resistor and of breaking a circuit through the resistor, which comprises:

(a) providing a resistive film on a substrate, (b) providing a small diameter stainless steel wire, (c) bending said wire to stress it, (d) connecting at least one end of said stressed wire to said substrate by a solder consisting essentially of tin an d silver, and (e) connecting said wire and said resistive film in a circuit with each other to thereby break said circuit when said tin-silver solder melts.

39. The invention as claimed in claim 38, in which said method further comprises providing terminal pins on one edge of said substrate and connecting the same to said resistive film, and securing said pins to said substrate by said tin-silver solder, and by the same operation.

40. The invention as claimed in claim 38, in which said method further comprises employing as said stainless steel wire a stainless steel wire that is silver plated.

41. A balancing network for telephone circuits, which comprises:

(a) a generally rectangular thin ceramic substrate having front and back surfaces that are parallel to each other, (b) two upper horizontal conductive traces applied to said front substrate surface in general alignment with each other and separated from each other by a gap, (c) two upper horizontal conductive traces applied to said back substrate surface in general alignment with each other and separated from each other by a gap, (d) two lower horizontal conductive traces applied to said front substrate surface in general alignment with each other and separated from each other by a gap, (e) two lower horizontal conductive traces applied to said back substrate surface in general alignment with each other and separated from each other by a gap, (f) first and second resistive films applied to said front surface and separated from each other by a gap, (g) third and fourth resistive films applied to said back surface and separated from each other by a gap, said first and third resistive films being on one half of said substrate, and each extending between said upper and lower traces on such one half, said second and fourth resistive films being on the other half of said substrate and each extending between said upper and lower traces on such other half, (h) first and second terminal pins mounted on the lower edge of said one half of said substrate, (i) third and fourth terminal pins mounted on the lower edge of said other half of said substrate, (j) means to connect said second and third pins, respectively, to said lower traces on said one half and said other half of said substrate, and (k) means to connect said first and fourth pins, respectively, to said upper traces on said one half and said other half of said substrate, said last-named means including electrically conductive end trace portions that are located at opposed ends of said substrate in spaced relationship from said respective resistive films.

said first and third films thus being connected in parallel with each other, said second and fourth films thus being connected in parallel with each other, said parallel-connected films on said one half of said substrate being balanced in combined resistance value relative to said parallel-connected resistive films on said other half of said substrate, said substrate, traces and resistive films being so related that application of 600 volts to said first and second pins, and to said third and fourth pins, will substantially instantaneously thermal-shock fracture said substrate at the upper-outer corner regions thereof and will break all of the circuits through all of said resistive films.

42. The invention as claimed in claim 41, in which there are no traces on said substrate between said upper horizontal conductive traces and the upper substrate edge, and in which said last-named means further includes bottom traces that are spaced below said lower horizontal traces and below the bottoms of said resistive films, and that are respectively near the opposite ends of said substrate, and that connect to said end trace portions.

43. The invention as claimed in claim 41, in which said means to connect said first and fourth pins, respectively, to said upper traces comprises substantially vertical end traces located between the outer ends of said conductive films and the ends of said substrate, said end traces being adapted to break in response to said fracture of said substrate, said end traces being said end trace portions, said end traces being spaced from the outer ends of said lower horizontal traces.

44. The invention as claimed in claim 41, in which glass coatings are provided on opposite sides of said substrate over said resistive films and traces thereon.

45. The invention as claimed in claim 41, in which said means to connect said second and third pins, respectively, to said lower traces on said one half and said other half of said substrate comprises conductive springs that extend over the top edge of said substrate, said springs being stressed in such manner that end portions thereof tend to spring away from said substrate, and in which solder is provided to hold said ends in contact with said substrate except after excess heat has melted said solder.

46. The invention as claimed in claim 45, in which said balancing resistor network is mounted on a telephone circuit board having holes therein respectively adapted to receive said pins, and in which heat sink pads are provided on said circuit board around said holes to create a high thermal gradient between said substrate and said circuit board.

47. A film-type resistor element, which comprises:

(a) a thin substrate having a front surface and a back surface, (b) a resistive film applied to said front surface of said substrate, (c) a resistive film applied to said back surface of said substrate, (d) first and second pads respectively provided on said back and front surfaces of said substrate in substantially registered relationship to each other, (e) a hook-end conductive spring wire, the hook end of said spring wire extending around an edge of said substrate in the vicinity of said pads, (f) solder to connect the extreme end of said hook end of said spring wire to said first pad, and to connect the adjacent region of said spring wire to said second pad, said spring wire being stressed when said hook end is thus soldered to said pads, so as to spring away from said substrate, (g) a third pad provided on said substrate on the same side thereof as the main body of said wire, (h) solder to connect a free end of said spring wire, remote from said hook end thereof, to said third pad, (i) means to connect one edge of one of said resistive films to said first pad, and (j) means to connect the corresponding edge of the other of said resistive films to said second pad, whereby said corresponding edges of said resistive films are connected to each other by the portion of said spring wire that hooks around said substrate edge.

48. The invention as claimed in claim 47, in which said films and substrate are so constructed and related to each other that said substrate fractures, at regions spaced from said hook-end spring wire, in response to sudden application of 600 volts to said films.

49. The invention as claimed in claim 47, in which said hook end is held by spring bias against said first pad and said second pad.

* * * * *